US009072958B2

(12) United States Patent
Muller

(10) Patent No.: US 9,072,958 B2
(45) Date of Patent: Jul. 7, 2015

(54) GOLF PRACTICE AID

(71) Applicant: J. Joseph Muller, St. Louis, MO (US)

(72) Inventor: J. Joseph Muller, St. Louis, MO (US)

( * ) Notice: Subject to any disclaimer, the term of this patent is extended or adjusted under 35 U.S.C. 154(b) by 31 days.

(21) Appl. No.: 13/947,540

(22) Filed: Jul. 22, 2013

(65) Prior Publication Data

US 2015/0024862 A1 Jan. 22, 2015

(51) Int. Cl.

| | |
|---|---|
| ***A63B 69/36*** | (2006.01) |
| ***A63B 57/00*** | (2015.01) |
| *A63B 71/06* | (2006.01) |

(52) U.S. Cl.

CPC ..... *A63B 69/3641* (2013.01); *A63B 57/00* (2013.01); *A63B 57/0075* (2013.01); *A63B 2071/0694* (2013.01)

(58) Field of Classification Search

USPC ..... 473/148, 180, 257, 267, 268, 280, 395, 473/396, 398; D21/791

See application file for complete search history.

(56) References Cited

U.S. PATENT DOCUMENTS

| | | | | | |
|---|---|---|---|---|---|
| 1,596,110 | A | * | 8/1926 | Lynch | 473/218 |
| 1,922,735 | A | * | 8/1933 | Johnson | 473/148 |
| 2,529,771 | A | * | 11/1950 | Herman | 473/143 |
| 3,705,962 | A | | 12/1972 | Banister | |
| 3,934,882 | A | * | 1/1976 | Whittaker | 473/257 |
| D242,370 | S | | 11/1976 | Arndt et al. | |
| 4,235,440 | A | * | 11/1980 | Hinckley | 473/257 |
| 4,429,882 | A | | 2/1984 | Stanton | |
| 4,765,625 | A | * | 8/1988 | Miner | 473/218 |
| D338,940 | S | * | 8/1993 | Pellington | D21/792 |
| 5,375,433 | A | | 12/1994 | Skalet | |
| D366,302 | S | * | 1/1996 | Marsh et al. | D21/792 |
| D400,631 | S | | 11/1998 | Moore | |
| 7,052,407 | B2 | * | 5/2006 | Patterson | 473/180 |
| D537,141 | S | | 2/2007 | Peterson | |
| 7,347,789 | B2 | * | 3/2008 | Patterson | 473/180 |
| D607,076 | S | | 12/2009 | Hadley | |
| D607,956 | S | | 1/2010 | Kershaw | |
| D624,982 | S | | 10/2010 | Perusa | |
| D673,235 | S | | 12/2012 | Lorenzana | |
| 8,323,120 | B2 | * | 12/2012 | Lorenzana | 473/280 |

* cited by examiner

*Primary Examiner* — Nini Legesse

(74) *Attorney, Agent, or Firm* — Polster, Lieder, Woodruff & Lucchesi, LC

(57) ABSTRACT

A practice aid for use by a golfer practicing hitting a golf ball (B) out of a sand trap. A disc (D) of predetermined diameter is placed on the top of the sand (S) with its leading edge either touching the underside of the golf ball or resting slightly behind it. When practicing a bunker shot, the golfer swings their club so it enters the sand immediately behind the trailing edge of the disc and passes through the sand beneath both the disc and the golf ball. The force imparted to the sand by the club causes the ball to fly out of the bunker on a cushion of sand. The disc provides an indication to the golfer as to how far behind the golf ball their club should enter the sand in order to hit the golf ball out of the sand trap.

4 Claims, 4 Drawing Sheets

GOLF PRACTICE AID

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

This invention relates to golf practice aids; and more particularly, to a practice aid for helping golfers hit a ball out of a bunker or sand trap.

At one time or another, almost all golfers have hit their golf ball into a sand trap or bunker which is typically located next to a green. The problem then facing the golfer is how to get their ball out of the trap and onto the green. Nothing is more frustrating for a golfer than to leave their ball in the sand trap when they try to hit it out; or blading the ball (i.e., hitting the ball rather than the sand) so it flies out of the bunker and over the green.

Golfers know from watching television or instruction videos, reading golf books and magazines, taking lessons from a golf instructor, or getting unsolicited advice from their playing companions that for a bunker shot they are not supposed to hit the ball, but rather swing their club into the sand some distance behind the ball. If done properly, the ball will be propelled from the bunker on a cushion of sand. So, the problem confronting the golfer is how far behind the ball should their club enter the sand. Too far behind the ball and it will probably stay in the sand. Too close to the ball and they risk hitting (blading) it and knocking it way too far.

BRIEF SUMMARY OF THE INVENTION

The present disclosure is directed to a practice aid that enables a golfer practicing bunker shots to readily see how far behind the ball their club should enter the sand. The aid is useful for practice in all types of sand, and is useful in practicing many types of sand shots.

In one embodiment the practice aid comprises a disc slightly larger than 2" in diameter. In other embodiments the aid can comprise a ring, a rectangular or square disc, or a disc of another geometric shape. Regardless of its shape, the disc is preferably slightly longer than 2" in length; although it can also be of other sizes.

During bunker practice, the practice aid is placed in the bunker behind a golf ball so that the front portion of the aid lies adjacent to, or is slightly touching the back of the ball. The golfer then swings his or her club so it enters the sand immediately behind the trailing edge of the practice aid. That is, the club enters the sand just behind the practice aid, approximately 2" behind the ball. If the club is swung with sufficient force the ball will be propelled out of the bunker on a cushion of sand. The practice aid may also fly out of the sand. How far the ball travels is a function of how aggressively the golfer swings their club into the sand.

The practice aid is made of a soft, pliable plastic material so if the golfer inadvertently hits the practice aid with their swing it will not break or shatter.

The practice aid is of a color which contrasts to that of the ball and the sand so to be distinctive in appearance to the golfer. The distinctive color also makes it easy to find and retrieve the practice aid after the golfer makes their shot since the practice aid will, as noted above, also usually be moved by the club's impact into the sand.

Besides bunker practice, the practice aid can also be used for practicing shots out of deep grass, or as an intermediate target for chip shots around the green or as a target to which a golf ball can be putted.

The size of the practice aid is such that it readily fits into a golfer's pocket or a pocket in a golf bag. The practice aid is low cost so the golfer can obtain a number of them for use in their bunker practice since this then allows them to set up and hit a series of bunker shots without having to retrieve the practice aid between each shot.

Other objects and features will be in part apparent and in part pointed out hereinafter.

BRIEF DESCRIPTION OF THE SEVERAL VIEWS OF THE DRAWINGS

The accompanying figures, which together with detailed description which follows, form part of the specification and illustrate the various embodiments described in the specification.

Corresponding reference characters indicate corresponding parts throughout the several views of the drawings.

DETAILED DESCRIPTION OF INVENTION

Figure 1A:
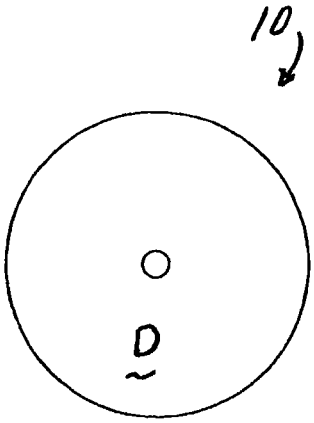
FIGS. 1A-1C are respective top plan, bottom plan and side views of a disc used as a practice aid for practicing bunker shots.
Figure 1B:
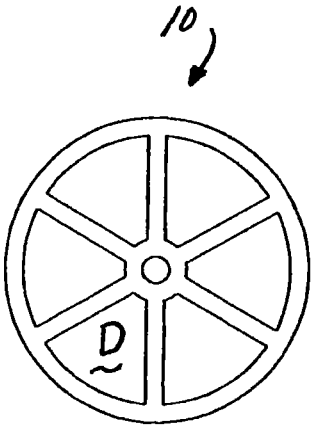
Figure 1C:
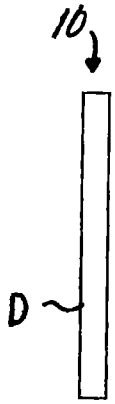

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a practice aid of the present invention is indicated generally 10. In one embodiment, practice aid 10 comprises a disc D which is approximately 2"-2½" in diameter and is preferably 2⅛" in diameter. As such, the disc is slightly larger in diameter than a golf ball which is 1.680" in diameter. The disc is made of a lightweight plastic material which, for example, has a durometer of approximately 60-70, although it could be more or less than that durometer. A disc D of such a durometer has the advantage in that it is soft, pliable or flexible, bends easily, and will not break apart or shatter when struck by an object such as a golf club C. Even if so struck, disc D will also not readily deform but will generally retain its original shape.

Figure 2:
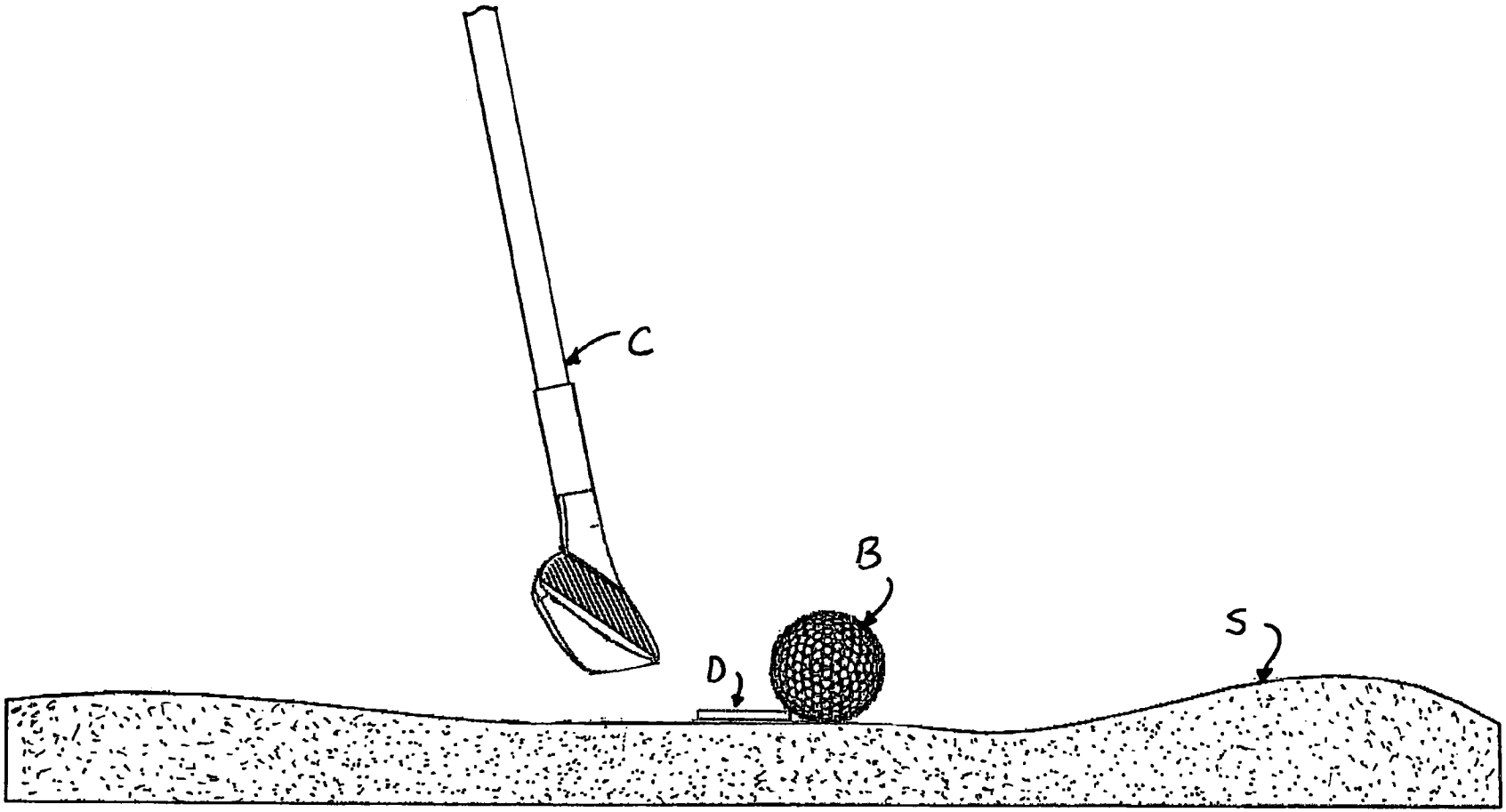
FIG. 2 illustrates placement of the practice aid behind a ball lying in the sand.

As shown in FIG. 2, when practicing a bunker shot, the golfer places disc D on the sand S directly behind a golf ball B. The front portion or leading edge of disc D can either touch the underside of ball B, or be placed slightly behind the ball. With this orientation, the trailing edge of disc D is now approximately 2" behind the golf ball which is generally agreed to be an acceptable distance to hit behind the ball to get it out of a bunker. It will be understood that the golfer does not have to press disc D into the sand or otherwise manipulate it. It is sufficient to just lay the disc on the top of the sand behind the ball.

As is known in the art, when hitting a golf ball out of sand, the golfer wants the leading portion (typically referred to as the "bounce") of his club C to enter the sand a distance behind the ball. Disc D now provides the golfer a visual aid to guide him or her and help them focus on where their club should enter the sand.

Figure 3:
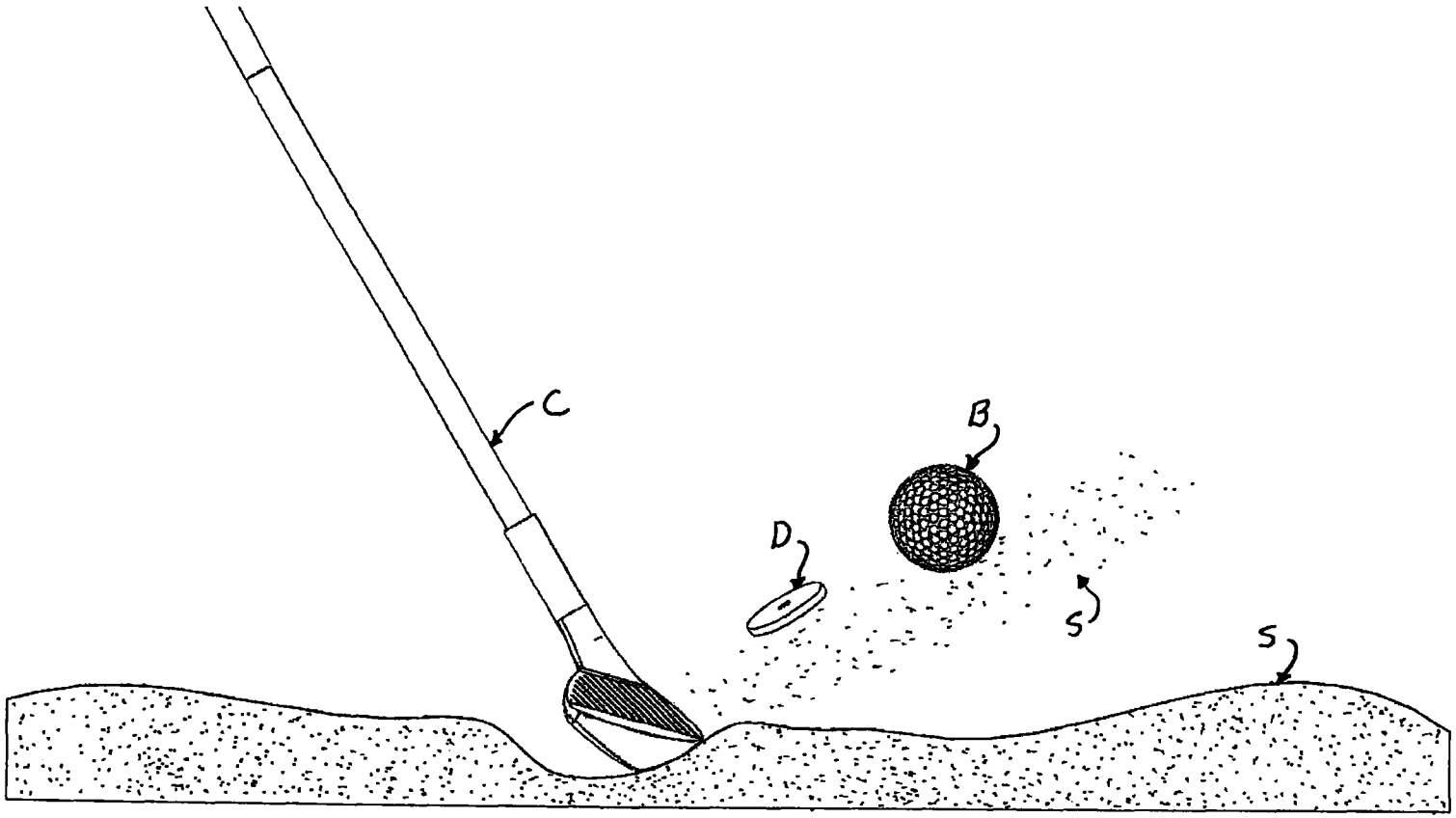
FIG. 3 illustrates how the ball and practice aid fly out of the sand when a golfer swings their club into the sand behind the practice aid.

Referring to FIG. 3, when the golfer swings their club C, typically a sand wedge or the like, into the sand immediately behind the back portion or trailing edge of disc D, the club will pass through the sand underneath both the practice aid and the ball. The force imparted to the sand by club C now causes the golf ball to be propelled or "float" out of the bunker on a cushion of sand. As shown in FIG. 3, disc D will also be propelled on the cushion of sand so to land elsewhere in the bunker, or on the grass surrounding the bunker, or even on the green.

It is important to understand that it is irrelevant how far disc 10 flies, or in what direction. What is important that, assuming the golfer swings their club with sufficient force, and does not quit on their swing when their club enters the sand, that ball B flies out of the sand.

After playing their sand shot, the golfer now retrieves the practice aid so they can use it in practicing their next bunker shot. To assist a golfer in locating practice aid 10, the practice aid is of a distinctive color; e.g., a highly visible orange color, so to be readily distinguishable from the golf ball (which is typically white), the sand (which ranges in coloring from white to a dark tan), and grass surrounding the bunker. It will be noted that because of its distinctive color, when the disc is placed in the sand behind the golf ball prior to a shot, it is readily distinguishable from the golf ball. This makes it easier for the golfer to focus on hitting behind the disc.

To assist in repetitively practicing bunker shots, disc D can be provided in a set of two or more so the golfer does not have to retrieve the disc after each shot. That is, the golfer can place a series of balls on top of the sand, place a practice aid behind each ball, so they can then make a number of shots before having to retrieve the practice aids. By repetitively practicing bunker shots using practice aid 10, the golfer can soon become proficient at hitting such shots. They can then practice shots without use of aid so to improve their expertise at hitting such shots.

It will be understood by those skilled in the art that practice aid 10 can be used for most types of bunker shots; that is, whether the ball lies on a generally flat portion of sand as shown in FIG. 2, or if the ball rests in an uphill, downhill, or side hill position. Those skilled in the art will further understand that for these latter ball positions adjustments may need to be made as to the golfer's setup prior to hitting the shot, but it is still desirable for practice to provide a simple visual indication as to where their club should enter the sand.

Besides use in practicing bunker shots around a green, practice aid 10 can also be used for practicing shots out of fairway bunkers. Here, the golfer wants to hit the ball before hitting the sand. What the golfer does now is reverse the positioning of the practice aid. That is, they place the trailing edge of disc D adjacent the front of the ball and now try to swing their club so it enters the sand immediately in front of the practice aid. Doing so will cause them to hit the ball with their club before the club enters the sand propelling the ball out of the sand and having it carry some distance.

Figure 4:
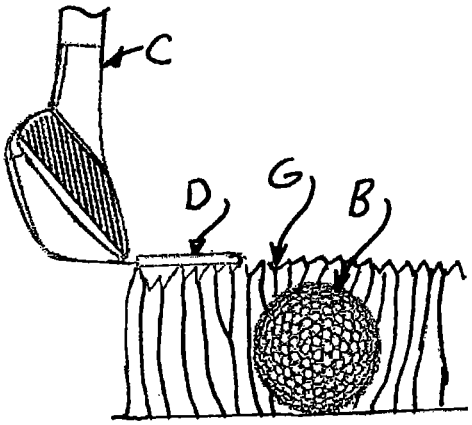
FIG. 4 illustrates use of the practice aid for hitting balls out of deep grass; and, FIGS. 5A-5F illustrate other embodiments of the practice aid.

The practice aid is further useful for other types of practice. For example, to practice shots that are buried in tall grass G (i.e., rough), the golfer sets disc D on top of the grass, as shown in FIG. 4, directly behind the ball. As with the bunker shot, the golfer swings their club so its leading edge enters the grass directly behind the disc. The club will then either make contact with the back of the ball, or glide through the grass slightly beneath the ball. In either instance, the ball will fly out of the grass toward an intended target.

Practice aid 10 can further be used as an intermediate target for practicing chip shots, or for practicing putting. In these situations, disc D is laid on the surface of the green with the golfer then chipping their ball B at the disc so that it lands near, or on, the disc and rolls toward a cup or hole. For putting practice, the golfer putts his ball over the surface of the green toward the disc which represents a cup or hole.

Figure 5A:
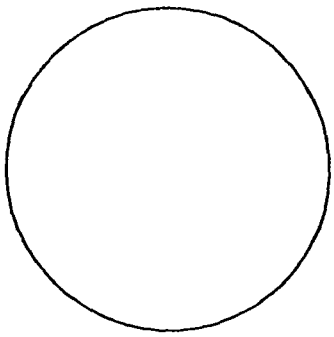
Figure 5B:
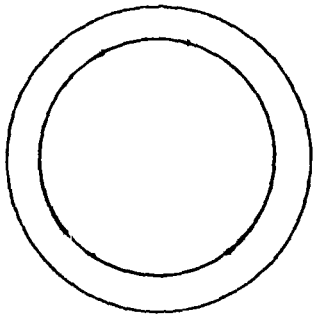
Figure 5C:
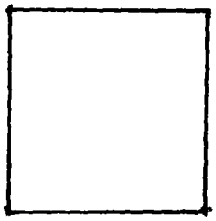
Figure 5D:
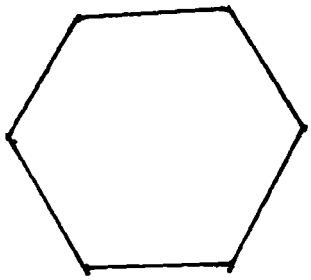
Figure 5E:
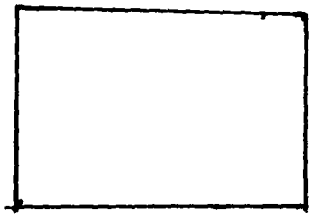
Figure 5F:
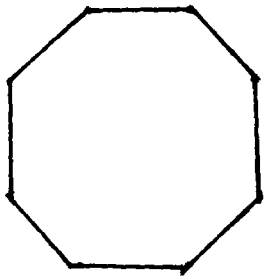

Referring to FIGS. 5A-5F, besides disc D, practice aid 10 can have other shapes. As shown in the drawings, it can be a disc without a center hole (FIG. 5A), ring shaped (FIG. 5B), square or rectangular (FIGS. 5C and 5D), and other geometric shapes such as a hexagon or octagon (FIGS. 5E and 5F). Other shapes are also possible without departing from the scope of the invention. It will also be understood the practice aid may be of a different size than as described above, with different sized aids being provided as a set.

In view of the above, it will be seen that the several objects and advantages of the present disclosure have been achieved and other advantageous results have been obtained.

Having thus described the invention, what is claimed and desired to be secured by Letters Patent is:

1. A method of practicing bunker shots in which a golfer tries to move a ball lying on sand in a bunker out of the bunker using a golf club comprising:

placing a generally planar practice aid having a leading edge and a trailing edge of a predetermined size on the top of the sand with the leading edge of the practice aid either touching the underside of the golf ball or resting slightly behind the golf ball;

the golfer, when practicing a bunker shot swinging their golf club so that it enters the sand immediately behind the trailing edge of the practice aid and passes through the sand beneath both the practice aid and the golf ball with the force imparted to the sand by the golf club causing the golf ball to fly out of the bunker on a cushion of sand, the practice aid providing a visual indication to the golfer as to how far behind the golf ball their golf club should enter the sand in order to hit the golf ball out of the bunker; wherein the practice aid comprises a disc made of a lightweight plastic material that is soft, pliable or flexible, bends easily, and will not break apart or shatter when struck by the golf club; and wherein the disc has a distinct color from that of the golf ball so that when the disc is placed in the sand behind the golf ball it is readily distinguished from the golf ball making it easier for the golfer to focus on hitting the sand behind the disc.

2. The method of claim 1 wherein the plastic material has a durometer of approximately 60-70.

3. The method of claim 1 in which the disc is larger in diameter than a golf ball.

4. The method of claim 1 in which the disc is further of a color distinctive from grass around the bunker or the sand in the bunker thereby making the disc easy to spot and retrieve after a stroke in the bunker is made using the practice aid.

* * * * *